US012449242B1

(12) United States Patent
Gupta et al.

(10) Patent No.: US 12,449,242 B1
(45) Date of Patent: Oct. 21, 2025

(54) HIGH-STRENGTH MUNITIONS STRUCTURE WITH TAILORED FRAGMENTATION

(71) Applicant: Washington State University, Pullman, WA (US)

(72) Inventors: Yogendra M. Gupta, Pullman, WA (US); Atakan Peker, Pullman, WA (US)

(73) Assignee: Washington State University, Pullman, WA (US)

( * ) Notice: Subject to any disclaimer, the term of this patent is extended or adjusted under 35 U.S.C. 154(b) by 16 days.

(21) Appl. No.: 18/403,172

(22) Filed: Jan. 3, 2024

(51) Int. Cl.

| | |
|---|---|
| ***F42B 12/20*** | (2006.01) |
| ***C22C 45/00*** | (2023.01) |
| ***F42B 12/24*** | (2006.01) |
| *F42B 12/76* | (2006.01) |

(52) U.S. Cl.
CPC ..... *F42B 12/207* (2013.01); *C22C 45/00* (2013.01); *F42B 12/24* (2013.01); *C22C 2200/02* (2013.01); *F42B 12/76* (2013.01)

(58) Field of Classification Search
CPC ..... F42B 12/207; F42B 12/24; F42B 12/76; C22C 45/00; C22C 2200/02
USPC ..... 102/506
See application file for complete search history.

(56) References Cited

U.S. PATENT DOCUMENTS

| | | | | |
|---|---|---|---|---|
| H1047 | H * | 5/1992 | Henderson | 102/389 |
| H1048 | H * | 5/1992 | Wilson | 102/389 |
| 5,131,329 | A * | 7/1992 | Lips | F42B 12/44 102/493 |
| 6,446,558 | B1 | 9/2002 | Peker | |
| 9,132,420 | B2 | 9/2015 | Nakayama et al. | |
| 9,389,054 | B2 * | 7/2016 | Dunaway | B22F 3/12 |
| 9,573,858 | B1 | 2/2017 | Brothers | |
| 9,702,676 | B1 * | 7/2017 | Gupta | C22C 45/10 |
| 10,267,608 | B2 | 4/2019 | Gupta et al. | |
| 11,454,480 | B1 * | 9/2022 | Algoso | B23H 9/14 |
| 2002/0036034 | A1 | 3/2002 | Xing et al. | |
| 2005/0087088 | A1 * | 4/2005 | Lacy | F42B 12/32 102/495 |
| 2006/0076089 | A1 | 4/2006 | Chang et al. | |
| 2006/0269765 | A1 | 11/2006 | Collier et al. | |
| 2007/0277914 | A1 | 12/2007 | Hugus et al. | |
| 2010/0024676 | A1 | 2/2010 | Hugus et al. | |
| 2010/0282115 | A1 | 11/2010 | Sheridan et al. | |
| 2012/0186733 | A1 | 7/2012 | Croopnick | |
| 2014/0045680 | A1 | 2/2014 | Nakayama et al. | |
| 2017/0268856 | A1 | 9/2017 | Gupta et al. | |

(Continued)

OTHER PUBLICATIONS

Hartwig, et al., "TEES Fianl Report to ARO (DARPA) on the SAM Project: High Density Amorphous Metal Matrix Composites for Kinetic Energy Penetrators", May 5, 2005, Texas Engineering Experimentation Station (TEES), pp. 1-15.

(Continued)

*Primary Examiner* — Samir Abdosh
(74) *Attorney, Agent, or Firm* — Lee & Hayes, P.C.

(57) ABSTRACT

A bulk metallic glass (BMG) material includes at least one high strength reactive alloy having a surface on which one or more surface features are formed. The one or more surface features are configured to at least partially control a fragmentation of the BMG material. The BMG material forms a cavity within which an explosive is configured to reside.

20 Claims, 9 Drawing Sheets

(56) References Cited

U.S. PATENT DOCUMENTS

| | | | | |
|---|---|---|---|---|
| 2020/0025540 | A1 | 1/2020 | Gupta et al. | |
| 2020/0378735 | A1 | 12/2020 | Gupta et al. | |
| 2021/0041215 | A1* | 2/2021 | Rastegar | F42B 12/32 |
| 2022/0357137 | A1 | 11/2022 | Gupta | |

OTHER PUBLICATIONS

Ling et al, "Spallation Behaviour of a Zr-Bulk Metallic Glass", EDP Sciences 2012, EPJ Web of Conferences 26 02003, pp. 1-6.

Office Action for U.S. Appl. No. 16/814,831, mailed on May 7, 2021, Gupta, "High Strength Munitions Structures With Inherent Chemical Energy", 8 Pages.

Office Action for U.S. Appl. No. 17/687,387, mailed on Dec. 14, 2022, Gupta, "High Strength Munitions Structures With Inherent Chemical Energy", 8 pages.

Office action for U.S. Appl. No. 14/491,152, mailed on Mar. 31, 2016, Gupta et al., "High Strength Munitions Structures With Inherent Chemical Energy", 5 pages.

Office Action for U.S. Appl. No. 15/616,849, mailed on Jun. 25, 2018, Gupta, "High-Strength Munitions Structures With Inherent Chemical Energy", 7 pages.

Office Action for U.S. Appl. No. 16/352,488, mailed on Jul. 22, 2019, Gupta, "High Strength Munitions Structures With Inherent Chemical Energy", 8 pages.

Office Action for U.S. Appl. No. 15/616,849, mailed on Sep. 22, 2017, Gupta, "High-Strength Munitions Structures With Inherent Chemical Energy" 5 pages.

Walters, et al., "Investigation of a bulk metallic glass as a shaped charge liner material"; Army Research Laboratory, Aug. 2006 (Year: 2006).

* cited by examiner

HIGH-STRENGTH MUNITIONS STRUCTURE WITH TAILORED FRAGMENTATION

BACKGROUND

Munitions systems (i.e., munitions) are made up of several components including a munitions structure, a warhead (e.g., explosives), fuses, stability components (e.g., wings, sabot, etc.), and a propulsion unit/propellant in the case self-propelled munitions (e.g., missiles). In conventional munitions, the warhead is the primary lethality component, that is, the primary component designed to impart damage to a target. On the other hand, the munitions structure is a structure designed to hold together the warhead and other components of the munition. Munitions exert their lethality by two primary damage mechanisms: a) blast pressure generated by the release of chemical energy, and b) mechanical impact (e.g., penetration with kinetic energy).

Munitions structures are typically made of conventional structural materials, such as steel or brass, and are generally regarded as non-energetic, that is lacking chemical energy release and no direct contribution to blast pressure generation. However, the fragmentation of conventional munitions structure may provide lethality and damage by mechanical impact. In munitions, it is desirable to tailor these two mechanisms for the most effective damage to a given target set.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features. The components, devices, and/or apparatuses depicted in the accompanying figures are not to scale and components within the figures may be depicted not to scale with each other.

DETAILED DESCRIPTION

Figure 1:
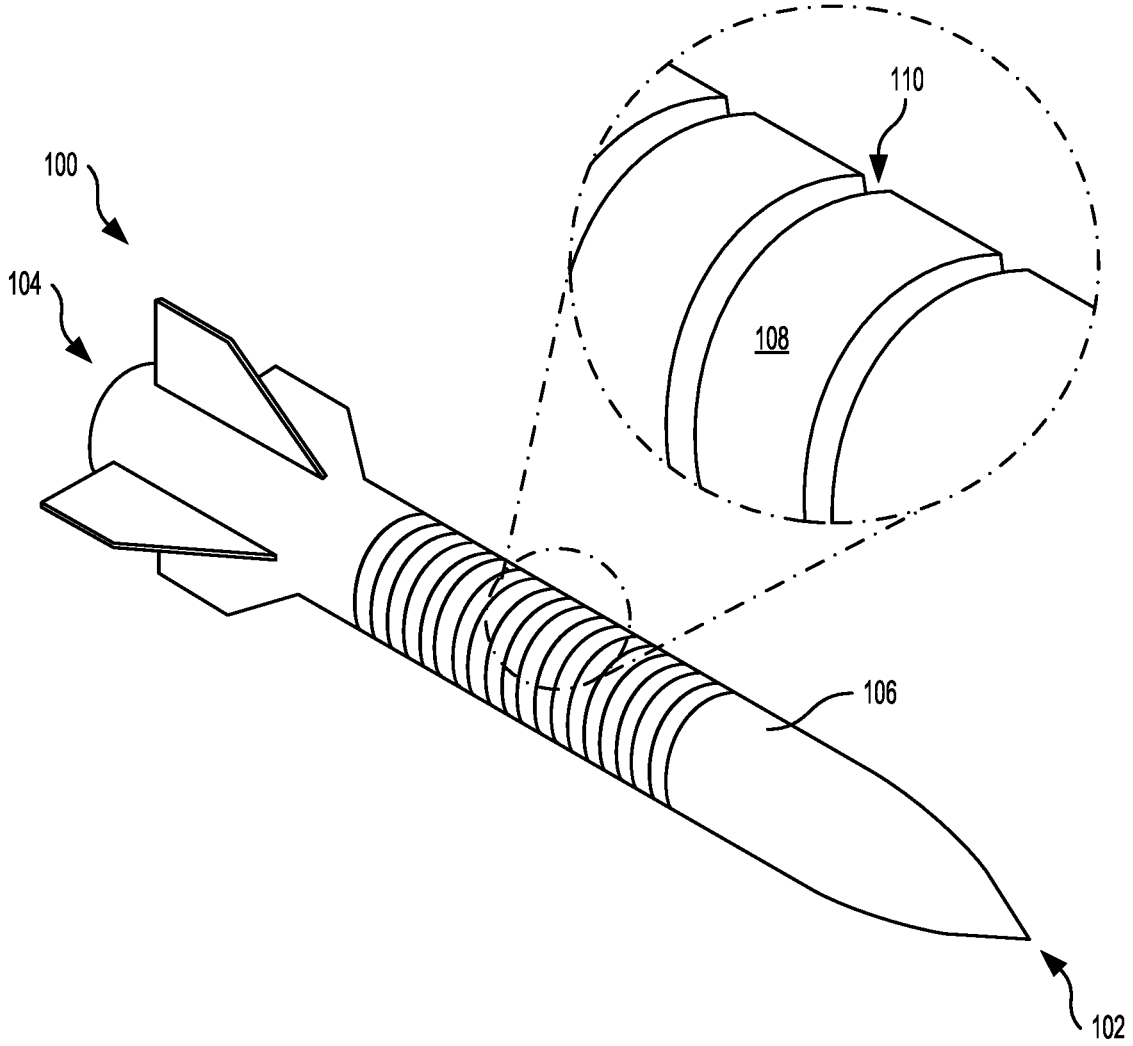
FIG. 1 illustrates an example munitions with an example munitions structure having geometric features for tailored fragmentation, according to an example of the present disclosure.

This application is directed, at least in part, to a munitions configured with tailored fragmentation, according to examples of the present disclosure. This application is also directed to a munitions, wherein the lethality mechanisms, blast pressure generation and mechanical impact, may be optimized with a desired fragmentation, or "fragment distribution" of the warhead and/or munitions structure. The munitions may include a munitions structure manufactured, or made, from a high-strength reactive alloy. In some instances, the high-strength reactive alloy may be designed and fabricated for tailored fragmentation. The tailored fragmentation may be achieved by geometric shaping of the munitions structure, particularly the geometric shaping of the high-strength reactive alloy. In some instances, the high-strength reactive alloy may be a bulk metallic glass (BMG), and the geometric shaping may be formed on, within, etc. the BMG. As used herein, geometric shaping may involve forming geometric features on surface(s) of the munitions structure. In some instances, the geometric shaping may be incorporated on typically non-functional smooth surfaces of the munitions structure.

For the purposes of this disclosure, as described and detailed in related applications, such as U.S. Pat. No. 10,267,608, the entirety which is hereby incorporated by reference, the term "reactive alloy" may refer to a metallic alloy with a high affinity to oxygen and/or nitrogen. A reactive alloy according to the present disclosure primarily includes early transition metals with a high affinity to oxygen such that oxide-free surfaces readily react and combust with oxygen (e.g., ambient oxygen). Examples include, but are not limited, to Zirconium (Zr), Hafnium (Hf), Titanium (Ti) and Niobium (Nb). Furthermore, a reactive alloy may have an enthalpy of oxidation at least 1,400 calories per gram of alloy, 1,800 calories per gram of alloy, or at least 2,000 calories per gram of alloy. Enthalpy of oxidation of a reactive alloy may be defined as the weighted average of the oxidation enthalpies of the alloy's constituent metals.

For the purposes of this disclosure, the term "high-strength reactive alloy" may refer to a metallic alloy having a yield strength of at least 120 kilopounds per square inch (ksi). Furthermore, a high-strength reactive alloy of the present disclosure may have an elastic strain limit of at least 1.2%. In some instances, a high-strength reactive alloy may have a yield strength of at least 160 ksi and an elastic strain limit of at least 1.5%. In some instances, a high-strength reactive alloy may have a yield strength of at least 200 ksi and an elastic strain limit of at least 1.8%. A high-strength reactive alloy of the present disclosure may have a density of at least 5.0 grams per cubic centimeter (g/cc), a density of at least 6.5 g/cc, or a density in a range of approximately 7.0 to approximately 8.0 g/cc.

In some instances, a high-strength reactive alloy of the present disclosure has a yield strength of at least 120 ksi, an elastic strain limit of at least 1.2%, an enthalpy of oxidation of at least 1,400 calories per gram of alloy (defined as the weighted average of oxidation enthalpies of the constituent metals), and/or a density of at least 5.0 g/cc. In some instances, a high-strength reactive alloy of the present disclosure may have a yield strength of at least 160 ksi, an elastic strain limit of at least 1.5%, an enthalpy of oxidation of at least 1,800 calories per gram of alloy, and/or a density of at least 6.5 g/cc. In some instances, a high-strength reactive alloy of the present disclosure may have a yield strength of at least 200 ksi, an elastic strain limit of at least 1.8%, an enthalpy of oxidation at least 2,000 calories per gram of alloy, and/or a density in the range of 7.0 to 8.0 g/cc. In some embodiments, an enthalpy of oxidation may be quantified in terms of calories per cubic centimeter (cc). A high-strength reactive alloy of the present disclosure may have an enthalpy of oxidation of at least 12,000 calories per cc of alloy, at least 15,000 calories per cc of alloy, and/or at least 18,000 calories per cc of alloy.

In some instances, the munitions, such as the munitions structure, includes one or more high-strength reactive alloys. In some instances, the at least one high-strength reactive alloy is a metallic glass. In some instances, the at least one high-strength reactive alloy is a bulk metallic glass (BMG).

"Metallic glasses" are metallic alloys with amorphous atomic structure in the solid state and have an amorphous or glassy phase. Metallic glasses are typically formed by quenching from the liquid state to avoid nucleation and growth of crystalline phases during solidification. Conventional metallic glasses generally require cooling rates of 105 K/sec or more and are correspondingly limited to thicknesses of 0.020 millimeters (mm) or less. This may limit the possible physical configurations into which metallic glass can be formed.

"Bulk Metallic Glass (BMG)" may be defined as an alloy of metallic glass that may be cast into a metallic glass object. Bulk metallic glasses, or bulk amorphous alloys, may be cooled at lower cooling rates as compared to metallic glasses, generally 500 K/sec or less, yet still substantially retain their amorphous atomic structure. As a result, BMGs may be produced in thicknesses of 1.0 mm or more. BMGs may therefore offer the distinct advantage of being formable into shapes with sizes which are substantially thicker/larger than shapes formed from a conventional metallic glass. U.S. Pat. Nos. 5,288,344; 5,368,659; 5,618,359; and 5,735,975, the disclosures of which are incorporated herein by reference in their entirety, described example bulk metallic glasses (BMGs) that may be used in accordance with the present invention.

In general, crystalline precipitates in BMGs may be detrimental to their properties, especially to toughness and strength. As a result, it may be generally preferred to minimize the volume fraction of these precipitates. However, there are cases in which ductile crystalline phases, precipitated in-situ during the processing of bulk metallic glasses, are in fact beneficial to the properties of BMGs, toughness and ductility being two such properties. BMGs having such beneficial precipitates may also be used in the practice of the present disclosure. Cast reactive alloys may be heat treated to provide precipitation of fine crystallites in the scale of from a few nanometers to a few micrometers and at varying volume fractions. In some instances, a "metallic glass object" or a "bulk metallic glass" may have at least 70% amorphous phase by volume. In some instances, a metallic glass object or a bulk metallic glass may have at least 95% amorphous phase by volume.

In some instances, the high-strength reactive alloy has a density of at least 6.0 g/cc, and the high-strength reactive alloy may be in BMG form. Alternatively, the munitions structure may include a high-strength reactive alloy, and where the high-strength reactive alloy is designed and fabricated for tailored fragmentation.

In some instances, the tailored fragmentation may be achieved by geometric shaping in the form of V-grooves with the bottom of the V having a radius from 0.5 mm to 3 mm. Additionally, or alternatively, tailored fragmentation may be achieved by geometric shaping in the form of semi-circular grooves with the radius of circle from 0.5 mm to 4.0 mm. The aforementioned V- and C-shaped grooves are exemplary forms of grooves and other shapes could also be employed to achieve the desired tailored fragmentation. In some instances, tailored fragmentation may be achieved by geometric shaping on an interior surface (internal cavity or concave surface) and/or exterior surface of the munitions structure. For example, the high-strength reactive alloy may enclose, or substantially enclose explosives, and the geometric shaping may be formed internal to the cavity or external to the cavity. In some instances, geometric shaping may be fabricated onto or into the munitions structure using various methods, such as direct machining, etching, milling, as-cast shaping and near-to-net shape thermoplastic forming, in the undercooled liquid state, as in the case of BMGs.

In some instances, the resulting size of the fragments from the munitions structure may be in a range of approximately 0.5 mm (e.g., +/−0.05 mm) to approximately 20 mm (+/−0.05 mm) in size. However, a resulting size of the fragments may be dependent upon an intended target and/or a desired combination of blast versus kinetic energy projectiles.

In some instances, the munitions may include a "geometric shaping factor (GSF)," which may be defined by the following. When the surface of the material with an area of X is flat and smooth (other than the inherent surface roughness), the GSF may be defined as one (i.e., 1.000). When some type of geometric shaping, such as by machining V-grooves, is implemented on the same surface and then the surface area increases to a value of Y, which would be a multiple of value X, the GSF of the new surface may then be defined as the ratio of Y to X. In some instances, the high-strength reactive alloy may be incorporated into the munitions structure with GSF of 1.2 or more, 2.0 or more. In some instances, the high-strength reactive alloy may be incorporated into a munitions structure with GSF of more than 3.0, or more than 5.0.

Still, in some instances, a depth of geometric shaping may have a certain fraction of an overall wall thickness of the munitions structure. For example, "a geometric thickness ratio (GTR)" may be defined as a ratio of a depth of the geometric shaping to the overall wall thickness of munitions structure. In some instances, the GTR may be in the range of from approximately 0.05 to 0.5, or 0.1 to 0.25 for shallow geometric features.

In some instances, a munitions structure may have an axially symmetric shape and a casing. In such instances, the casing may include the high strength reactive alloy and may be filled with explosives. Examples of explosives include but are not limited to TNT, HMX, and/or RDX. In some instances, the explosives may be fitted with one or more fuses. The casing may also have other structural materials such as high strength steel, maraging steel, and aluminum alloys. In some instances, the munitions structure may be configured as a protective case to enable or improve penetration through one or more protective targets and/or produce a blast upon on-demand applied stimulus/stimuli. In some instances, a thickness of a liner may be selected according to a desired blast and other characteristics of the munitions, such as the size and distribution of kinetic energy projectiles. In some instances, where the munitions structure comprises a Zr-based bulk metallic glass, a liner thickness may be less than 20 mm and more than 1 mm, or less than 10 mm and more than 3 mm. The configuration of the BMGs into the munitions structures may provide increased lethality (for both large and small penetrators) by rapidly and simultaneously imparting mechanical energy (kinetic energy through impact, penetration, and fragmentation) and chemical energy (blast and/or fireball to a target).

In some instances, a ratio of the mass of the structural components of the munitions structure (e.g., the total mass of high-strength reactive alloy and other structural components comprising the munitions structure) to the mass of explosives in the munitions (this ratio being designated as M/C) may be in the range of from 1.0 to 10.0. In some instances, the M/C may be in the range of 1.5 to 6, or from 2.5 to 4.

In some instances, the incorporation of a high-strength reactive alloy, in particular one in BMG form, into the munitions structures with tailored fragmentation may produce both higher blast, rapid pressure increase in ambient environment, and also multiples of kinetic energy projectiles resulting in significant improvement of lethality. As noted above, the high-strength reactive alloys in their bulk solid forms are practically inert under normal operating conditions (e.g., ambient temperature and atmosphere). However, these reactive alloys possess significant intrinsic chemical (enthalpic) energy of up to 2,000 calories per gram of alloy and, in the case of some reactive alloys, even more. The munitions structure as described herein uses intrinsic energy for producing at least part of the blast generated by tailored fragmentation. This chemical energy may be discharged through a combustion reaction with ambient air, in particular oxygen and/or nitrogen. The combustion reaction may be activated upon the fragments impacting onto a target.

In some instances, one or more resulting fragments of the high-strength reactive alloy may start a combustion reaction with the available oxygen/nitrogen. The intrinsic chemical energy of high-strength reactive alloy may be discharged via the combustion reaction into the environment, producing rapid pressure increase and blast. This pressure increase may also be associated with a fireball and a high temperature rise in the environment, thereby providing further lethality.

The high-strength reactive alloys as described herein have a unique ability to sustain large mechanical strains without significant deformation given their high strength and high elastic strain limit. Once fragmentation of a high-strength reactive alloy starts with the aid of geometric shaping, such stored mechanical energy facilitates the formation of a more uniform fragment distribution as compared with the fragment distribution of conventional munitions systems. Stored mechanical energy from initial stages of rapid impulsive loading preceding and/or concomitant with the initiation of fragmentation opens a large amount of free surfaces which are oxide free from the solid bulk form of the high-strength reactive alloy. The opening of oxide-free free surfaces from the bulk of the high-strength reactive alloy, and especially with the formation of fine and generally uniform fragments, is crucial for the prompt reaction initiation, and increasing the lethality of the munitions structure into which it is incorporated.

In some instances, the high-strength reactive alloy may be fragmented such that 50% of the fragment distribution is less than 1,000 micron in size. In some instances, 80% of the fragment distribution is less than 1,000 micron in size. Alternatively, a high-strength reactive alloy may be fragmented such that 50% of fragment distribution is less than 200 micron in size. In some instances, 80% of fragment distribution may be less than 200 micron in size.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIG. 1 illustrates an example munitions 100 including geometric shaping, according to an example of the present disclosure. In some instances, the munitions 100 may include a first end 102 spaced apart from a second end 104. In some instances, a munitions structure 106 may extend between the first end 102 and the second end 104. In some instances, the munitions structure 106 may include a high-strength reactive alloy. In some instances, the munitions structure 106 may be formed from a single piece of material, or multiple pieces of material. In such instances, the munitions 100 may be formed from any number of high-strength reactive alloys with different shapes, sizes, etc.

Moreover, although FIG. 1 illustrates a particular size, shape, and/or features of the munitions 100, other shapes, sizes, features, etc. are envisioned. For example, the munitions 100 may be configured for large munitions, such as a missile, as well as small munitions, such as a bullet. Munitions may be configured into a variety of shapes and forms as part of various munitions, including but not limited to small caliber bullets, kinetic energy penetrators, and massive ordnance penetrators. For example, in some instances, the munitions may be configured into a bullet of .50 caliber or smaller. Penetrators are designed to pass through and into a target, useful in scenarios in which a target is armored or shielded.

In the example of FIG. 1, the high-strength reactive alloy may form a casing in which explosives of the munitions 100 are disposed. In other instances, and as will be explained herein, a casing (e.g., steel) may be at least partially disposed around the high-strength reactive alloy. The munitions structure 106, or the high-strength reactive alloy, may include a surface 108 into which one or more geometric features 110 are formed. In some instances, the geometric features 110 may represent grooves formed on, within, or in the surface 108. In some instances, the geometric features 110 are formed on portions of the surface 108 that are conventionally non-functional smooth surfaces of the munitions structure 106, and/or which are free of specific surface features such as threads and other auxiliary forms for other purposes such as attachment of another component of a munition, such as a fuse. As such, although the geometric features 110 are shown disposed at a certain location on the surface 108 (e.g., between the first end 102 and the second end 104), or more generally, the munitions structure 106, the geometric features 110 may be formed on other surfaces of the munitions structure 106, as well as more than or less than the amount as shown on the surface 108. For example, the geometric features 110 may be formed around a circumference of the surface 108, or less than a circumference of the surface 108.

The geometric features 110 formed on or within the surface 108 may result in a tailored fragmentation of the munitions structure 106, or at least a portion thereof, upon impact to a target, detonation, etc. For example, the munitions structure 106 may be configured to fragment along the geometric features 110. In some instances, a resulting size of the fragments from the munitions structure 106 range between approximately 0.5 mm to 20 mm in size. In some instances, a size of the fragments may be based on an intended target and a desired combination of blast versus kinetic energy projectiles. For example, tailored fragmentation may be achieved by adjusting one or more dimensions of the geometric features 110, such as a depth, width, length, etc., an orientation of the geometric features 110, an amount (e.g., number, quantity, etc.) of the geometric features 110 on the surface 108, a spacing between the geometric features 110, and so forth. The characteristics of the geometric features 110 may have an effect on whether the munitions 100 is configured to generate lethality via blast or direct mechanical impact.

In some instances, when the munitions structure 106 is formed from the high-strength reactive alloy, and particularly when the high-strength reactive alloy is in BMG form, the high-strength reactive alloy may have a limited fracture toughness, which is typically in the range of from 20 to 100 in units of ksi.sqrtin (e.g., in respective units of kilopounds per square inch (ksi) and inches). This value range of fracture toughness along with an elastic strain limit of at least 1.2% may provide a clean breakage and tailored fragmentation of the munitions structure 106.

In some instances, a reactive bulk metallic glass is a Zr-based bulk metallic glass (BMG). Zr-based BMG may be defined as a metallic alloy with Zr content being more than 35 atomic percent. Broadly described, Zr-based BMGs comprise Zr and two or more elements from the group of (Cu, Ni, Fe, Co, Hf, Nb, Ta, Ti, and Al). A variety of other elements may be added, or substituted, into the latter group of elements. These additional elements include Mo, Y, V, Cr, Sc, Be, Si, B, Zn, Pd, Ag, and Sn, and may be added in modest amounts, and preferably at 3 atomic percent or less. In some instances, a reactive Zr-based BMG is quaternary (four components) or a higher order alloy system, where the Zr-based BMG includes at least one element from the group of (Hf, Ti, Nb, Ta), at least one element from the group of (Cu, Ni, Fe, Co), and Al. In some instances, a reactive Zr-based BMG is quinary (five components) or a higher order alloy system, where each of at least three components is 5 atomic percent or more. In some instances, a reactive Zr-based BMG is six component or a higher order alloy system, where each of at least four components is 5 atomic percent or more.

Zr-based BMG reactive alloys can be broadly described by the following formula: Zra Hfb (Ta, Nb, Ti)c Cud (Ni, Fe, Co)e Alf. In some instances, a is in the range of from 30 to 60, b is in the range of from 0 to 20, c is in the range of from 0 to 8, d is in the range of from 0 to 40, e is in the range of from 0 to 30, and f is in the range of from 5 to 25. In some instances, a is in the range of from 35 to 55, b is in the range of from 0 to 20, c is in the range of from 0 to 6, d is in the range of from 5 to 40, e is in the range of from 0 to 20, and f is in the range of from 7 to 15. In some instances, a is in the range of from 40 to 55, b is in the range of from 0 to 14, c is in the range of from 2 to 5, d is in the range of from 10 to 35, e is in the range of from 5 to 20, and f is in the range of from 8 to 11.

In some instances, a+b is in the range of from 40 to 70, and d+e is in the range of from 10 to 50. In some instances, a+b+c is in the range of from 50 to 65 and d+e is in the range of from 20 to 40. In some instances, a variety of other elements can also be added to alloys of the above given formula. These additional elements may include Mo, Y, V, Cr, Sc, Be, Si, B, Zn, Pd, Ag, and Sn, and may be added at 3 atomic percent or less in total, and in some instances at 1 atomic percent or less in total.

In some instances, the ratio of (a+b+c) to (d+e) is in the range of from 1.2 to 2.5. In some instances, Zr-based bulk metallic glass includes one or more of (Ti and Nb), where the ratio of (Zr+Hf)/(Ti+Nb) is in the range of from 10 to 20. Still, in some instances, a Zr-based bulk metallic glass includes Hf and one or more of (Ti and Nb), where the ratio of Hf/(Ti+Nb) is in the range of from 2 to 5. In some instances, the ratio of Hf/(Ti+Nb) is in the range of from 3 to 4. In some instances, Zr-based bulk metallic glass comprises Hf and Nb, where the ratio of Hf/Nb is in the range of from 2 to 5.

In some instances, the amorphous atomic structure (glassy phase) of Zr-based BMGs provides a very high yield strength and high elastic strain limit. For example, Zr-based BMGs as described above typically have yield strength of at least 180 ksi and an elastic strain limit of at least 1.6%. Given the constituent metals, the enthalpy of oxidation (defined as the weighted average of oxidation enthalpies of the constituent metals) may be at least 1,800 calories per gram of alloy, and a density may be in a range of 6.0 to 8.5 g/cc. In some instances, Zr-based BMGs have yield strength of at least 200 ksi, elastic strain limit of at least 1.8%, enthalpy of oxidation of at least 2,000 calories per gram of alloy, and density in the range of 6.5 to 8.0 g/cc.

The incorporation of a high-strength reactive alloy, in particular a BMG, into the munitions structure 106 may achieve one or more of the following advantages over conventional munitions structures/systems. For example, the overall explosives content and sensitivity of the munitions 100 is significantly less while a penetration and blast generation characteristics of the munitions 100 are generally maintained the same. The penetration and/or blast generation characteristics of the munitions structure 106 is significantly better. The overall weight of the munitions structure 106 is significantly less and/or the munitions 100 is configurable into a more compact packaging while preserving or improving penetration and blast generation characteristics (that is, without resulting in inferior penetration and blast generation characteristics as compared to a comparable conventional munitions system). The use of high-strength reactive alloys, and particularly reactive BMGs, in the munitions structure 106 allows for the munitions 100 that are improved over conventional munitions systems using high explosives and inert structural cases which do not include high-strength reactive alloys.

The munitions structure 106 including the high-strength reactive alloy may be fragmented by rapid impulsive loading. As described in detail below, the resulting fragments of the high-strength reactive alloy initiate a combustion reaction with ambient atmosphere and produce rapid pressure increase facilitated by enthalpic energy of the combustion reaction. Given this and other attributes as detailed below, the munitions structure 106 provides the advantages of a significantly reduced amount of explosives and a significantly reduced amount of inert structural material in munitions systems.

In some instances, the munitions structure 106 may include a "geometric shaping factor (GSF)" or be characterized as having a certain GSF. The GSF may be calculated as a ratio of the selected surface area of the munitions structure 106 with the geometric features 110 (e.g., a first surface area), and a surface area of the munitions structure 106 without the geometric features 110 (e.g., a second surface area). In other words, when the surface 108 does not have the geometric features 110, and is flat and smooth (other than the inherent surface roughness), the surface area of the surface 108 may be defined measured as a value of "X" and then the GSF is defined may be one (i.e., 1.000). However, when the geometric features 110 are formed on the surface 108, the surface area of the surface 108 increases to a value of Y, which may be represented as a multiple of the value of X. The GSF of the surface 108 may then defined as the ratio of value of Y to the value of X.

Stated alternatively, in instances in which the surface 108 does not include the geometric features 110, the surface 108 may have a baseline surface area. When the geometric features 110 are formed on the surface 108, the surface 108 may have an increased surface area, which may represent an addition of a surface area to the baseline surface area. In other words, the geometric features 110 may add to the surface area of the surface 108.

Another way to describe the GSF may be as follows. When the surface 108 has the geometric features 110 (e.g., grooves etc.), the surface area of the surface 108 may be the value "Y". When the surface 108 is covered or enveloped into a 2D surface, the surface area of the surface 108 may be measured as the value of X. The GSF of the surface 108 may then defined as the ratio of the value of Y to the value of X.

In some instances, the GSF of the munitions structure 106 may be 1.2 or more. Additionally, or alternatively, the GSF of the munitions structure 106 may be 2.0 or more. However, greater GSFs are envisioned, such as the GSF being more than 3.0 or more than 5.0. In some instances, a larger GSF may increase an amount of fragments generated from the high-strength reactive alloy. In some instances, a GSF between 1.0 and 2, or less than 2.5, may result in the munitions structure 106 being configured for a mechanical type of impact. In some instances, a GSF greater than 2.5 may result in the munitions structure 106 being configured to generate a blast.

The munitions 100 as described herein may produce significant blast, rapid pressure increase in ambient environment, and as a result, allow for significant reduction or elimination of a need for high explosives used for blast generation in conventional munitions. The high-strength reactive alloys in their bulk solid forms are practically inert under normal operating conditions (ambient temperature and atmosphere). However, these reactive alloys possess significant intrinsic chemical (enthalpic) energy of up to 2,000 calories per gram of alloy and, in the case of some reactive alloys, even more. The munitions 100 incorporates the use of such intrinsic energy for producing at least part of the blast. This chemical energy may be discharged through a combustion reaction with ambient air, in particular oxygen and/or nitrogen. The combustion reaction may be activated under certain circumstances and by an on-demand applied stimuli.

The munitions 100 may include other components to enable its operation, such as one or more fuses, one or more stability components (e.g., wings, sabot, etc.), a propulsion unit supplied by a propellant vessel, etc. Although not shown, as will be discussed herein, the munitions 100 may be encased with a shell or body (e.g., a high strength steel or other structural material).

Figure 2:
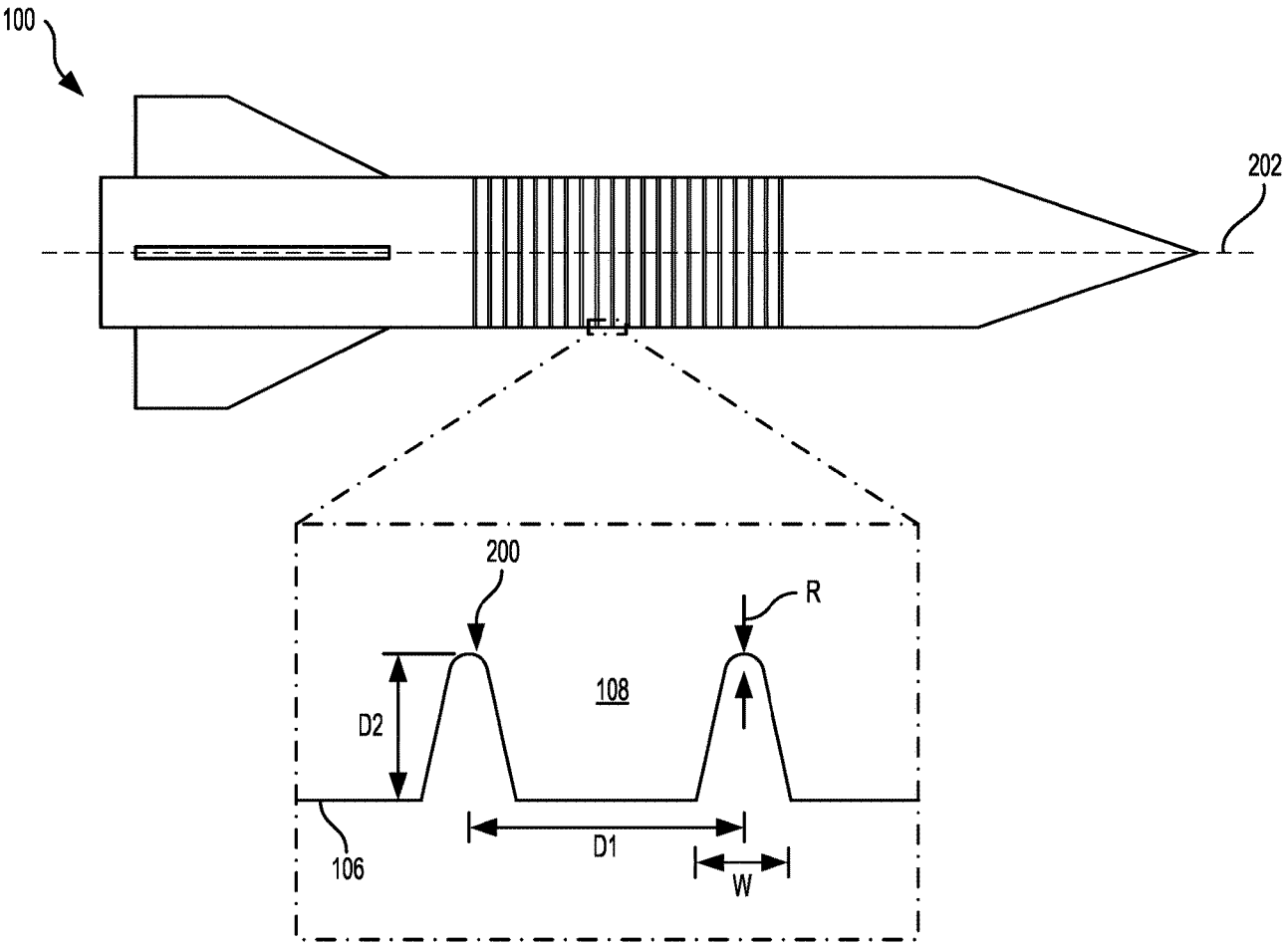
FIG. 2 illustrates example geometric features formed in the munitions structure of FIG. 1, according to an example of the present disclosure.

FIG. 2 illustrates a detailed view of example geometric features 200 on the munitions 100, according to an example of the present disclosure. The geometric features 200 may be similar to, or different from, the geometric features 110.

As shown in the example of FIG. 2, the geometric features 200 may be "V-shaped" grooves formed on the surface 108 (e.g., V-shaped cross-section). The geometric features 200 may be spaced apart from one another by a distance D1, in a direction along a longitudinal axis 202 of the munitions structure 106. In an embodiment, the distance D1 may be between approximately 2.0 mm and approximately 5.0 mm (e.g., +/−0.05 mm). However, other distances D1 are envisioned (e.g., 1.0 mm, 10 mm, 25 mm, etc.). Moreover, the distance D1 disposed between the geometric features 200 may be similar, or different. For example, a first geometric feature of the geometric features 200 and a second (adjacent) geometric feature of the geometric features 200 may be spaced apart by a distance of 2.0 mm, while the second geometric feature and a third geometric feature of the geometric features 200, adjacent to the second geometric feature, may be spaced apart by a distance of 5.0 mm.

The geometric features 200 may also include a depth D2 (e.g., into the surface 108). In some instances, the depth D2 may be between approximately 2.0 mm and approximately 5.0 mm (e.g., +/−0.05 mm). However, other depths D2 are envisioned (e.g., 0.1 mm, 0.5 mm, 10 mm, etc.). In an embodiment, the distance D1 and the depth D2 may be the same or different as compared to one another. Moreover, the depth D2 of the geometric features 200 may be similar, or different, as compared to some another. For example, a first geometric feature of the geometric features 200 may have a first depth, such as 2.0 mm, while a second geometric feature of the geometric features 200 may have a second depth, such as 5.0 mm. In some instances, the greater of the depth D2 of the geometric features 200 may equate to a larger blast radius of the fragments that result from the high-strength reactive alloy of the munitions structure 106. For example, when the geometric features 200 have a depth of 5.0 mm, fragments may be cast farther away from the munitions structure 106 during detonation, impact, etc., as compared to when the geometric features 200 have a depth of 1.0 mm.

In some instances, the depth D2 of the geometric features 200 may be represented as a fraction of an overall wall thickness of the munitions structure 106. For example, defining a geometric thickness ratio (e.g., GTR), where the ratio of depth D2 of the geometric features 200 to the overall wall thickness of munitions structure 106, the GTR may be in a range of from between 0.02 to 0.5, 0.05 to 0.20, and/or 0.1 to 0.2.

The geometric features 200 may also include a width W. In some instances, the width W may be approximately 1.0 mm to approximately 3.0 mm (e.g., +/−0.05 mm). However, other widths W are envisioned (e.g., 0.5 mm, 5 mm, 10 mm, etc.). In some instances, the distance D1, the depth D2, and/or the width W may be the same or different as compared to one another. Moreover, the width W of the geometric features 200 may be similar, or different, as compared to some another. For example, a first geometric feature of the geometric features 200 may have a first width, such as 2.0 mm, while a second geometric feature of the geometric features 200 may have a second width, such as 0.5 mm.

In some instances, the geometric features 200 may have a radius R, which is a disposed at a bottom of the geometric features 200 (e.g., within the munitions structure 106). The radius R may be disposed between opposing sidewalls of the geometric features 200. In some instances, the radius R may be between approximately 0.5 mm and approximately 3.0 mm (e.g., +/−0.05 mm). However, other Radii R are envisioned (e.g., 1.0 mm, 2.0 mm, etc.). The radius R may prevent inadvertent fragmentation, for example, prior to a pressure within the munitions structure 106 being built up (e.g., premature detonation). That is, stated alternatively, if a bottom of the geometric features 200 were sharp (e.g., came to a sharp point), inadvertent fractures may be formed in the munitions structure 106. These fractures may reduce a lethality of the munitions 100. Moreover, the sharper points may result in less pressure being built up within the munitions prior to fragmentation.

In some instances, the geometric features 200 may be formed in the surface 108 using various methods, such as direct machining, as-cast shaping and near-to-net shape thermoplastic forming, in the undercooled liquid state, as in the case of BMGs. As illustrated, the geometric features 200 may be formed on the outside (e.g., the surface 108) of the munitions structure 106. In some instances, the geometric features 200 may be formed in the surface 108, about the longitudinal axis 202. Moreover, in some instances, the geometric features 200 may extend around an entirety of a circumference of the surface 108 (e.g., about/around the longitudinal axis 202), or less than the entirety of the circumference of the surface 108. Moreover, in some instances, the geometric features 200 may be formed about the longitudinal axis 202, in a direction that is perpendicular to the longitudinal axis 202.

Figure 3:
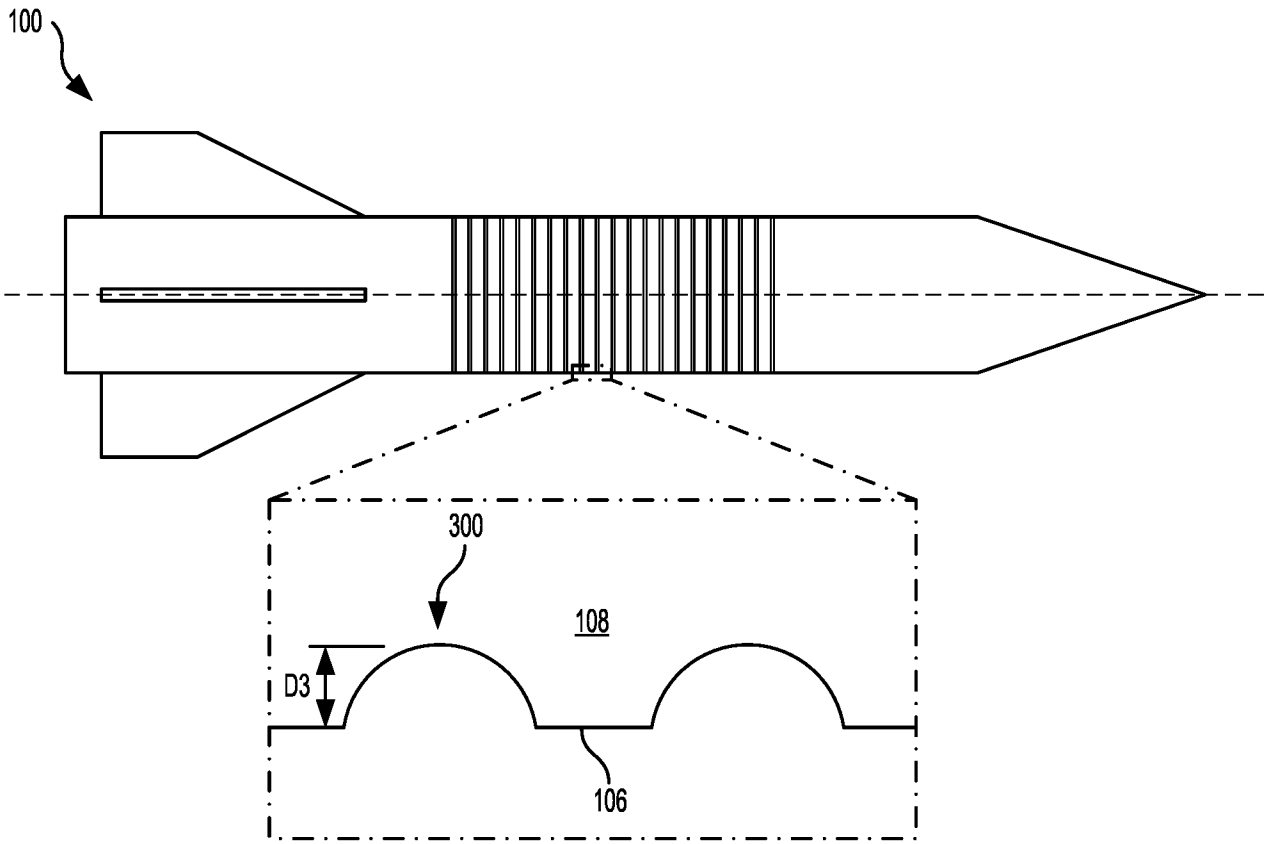
FIG. 3 illustrates example geometric features formed in the munitions structure of FIG. 1, according to an example of the present disclosure.

FIG. 3 illustrates a detailed view of example geometric features 300 on the munitions 100, according to an example of the present disclosure. The geometric features 300 may be similar to, or different from, the geometric features 110.

Compared to the geometric features 200, which are described above as being "V" shaped grooves, the geometric features 300 are shown being semi-circular in shape (e.g., "C" shaped cross section). In some instances, the geometric features 300 may include a depth D3 (or a radius of the circle). In some instances, the depth D3 may be between approximately 0.5 mm and approximately 4.0 mm (e.g., +/−0.05 mm). In some instances, the depth D3 of the geometric features 300 may be the same or different as compared to one another. For example, a first of the geometric features 300 may include a first depth, such as 3.0 mm, while a second of the geometric features 300 may include a second depth, such as 4.0 mm. In other respects, the geometric features 300 may be similar to the geometric features 110 and/or the geometric features 200 (e.g., GSF, GTR, etc.).

Although the geometric features 200 and the geometric features 300 are described as having "V"shaped" and "C" shaped grooves, respectively, other shapes are envisioned for achieving a desired fragmentation. For example, the geometric features of the munitions structure 106 may include square shaped grooves, ovular shaped grooves, hexagonally shaped grooves, and so forth. Moreover, although described as grooves, the geometric features may represent channels, conduits, ribs, passages, etc. formed on, within, about, etc. the munitions structure 106.

Figure 4:
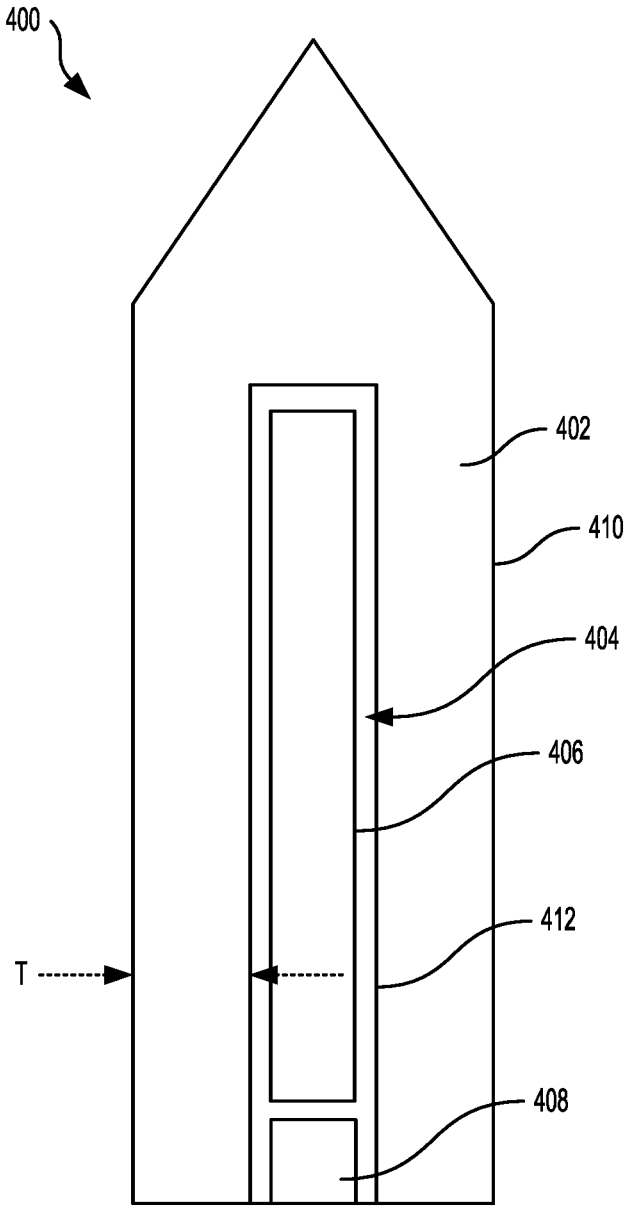
FIG. 4 illustrates an example munition structure of an example munitions, according to an example of the present disclosure.

FIG. 4 illustrates an example munitions 400, according to an example of the present disclosure. The munitions 400 may be similar to, or different than, the munitions 100.

The munitions 400 includes a munitions structure 402 with an axially symmetric shape. The munitions structure 402 may be made from a high-strength reactive alloy, which forms a casing of the munitions structure 402. The high-strength reactive alloy may define a cavity 404 that is filled (or at least partially filled) with explosives 406. For example, the high-strength reactive alloy may enclose, or substantially enclose, the explosives 406. Examples of the explosives 406 which may be used in the munitions structure 402 include but are not limited to TNT, RDX, HMX and RDX. In some instances, the explosives 406 are fitted with one or more fuses 408.

The munitions structure 402 may include an exterior surface 410 (e.g., similar to the surface 108), and an interior surface 412 disposed adjacent to the explosives 406. The munitions structure 106 may be formed at least in part by the high-strength reactive alloy. The interior surface 412 may at least partially define the cavity 404 in which the explosives 406 are disposed. The munitions structure 402 may include a thickness T, extending between the exterior surface 410 and the interior surface 412.

In some instances, the geometric features 110 may be formed on the exterior surface 410 and/or the interior surface 412. As noted above, and in some instances, the geometric features 110 may include a geometric thickness ratio (e.g., GTR), where a ratio of depth (e.g., into the exterior surface 410 and/or the interior surface 412) of the geometric features 110 to the thickness T of the munitions structure 106, may be in a range of from between 0.02 to 0.5, 0.05 to 0.20, and/or 0.1 to 0.2.

The munitions 100 is shown not including a casing that surrounds the munitions structure 402 (e.g., the high-strength reactive alloy). In some instances, elimination of a casing may result in improved performance of the munitions structure 402 and reduced non-energetic weight of the casing in conventional munitions. The munitions structure 106 may replace the casing entirely, thereby reducing non-energetic weight and providing greater insensitivity to the munitions 400 as a whole. Improved insensitivity may allow the munitions 400 to be launched by a propulsion unit generally not possible for munitions with conventional explosives, for example, an electromagnetic propulsion based propulsion unit.

Figure 5:
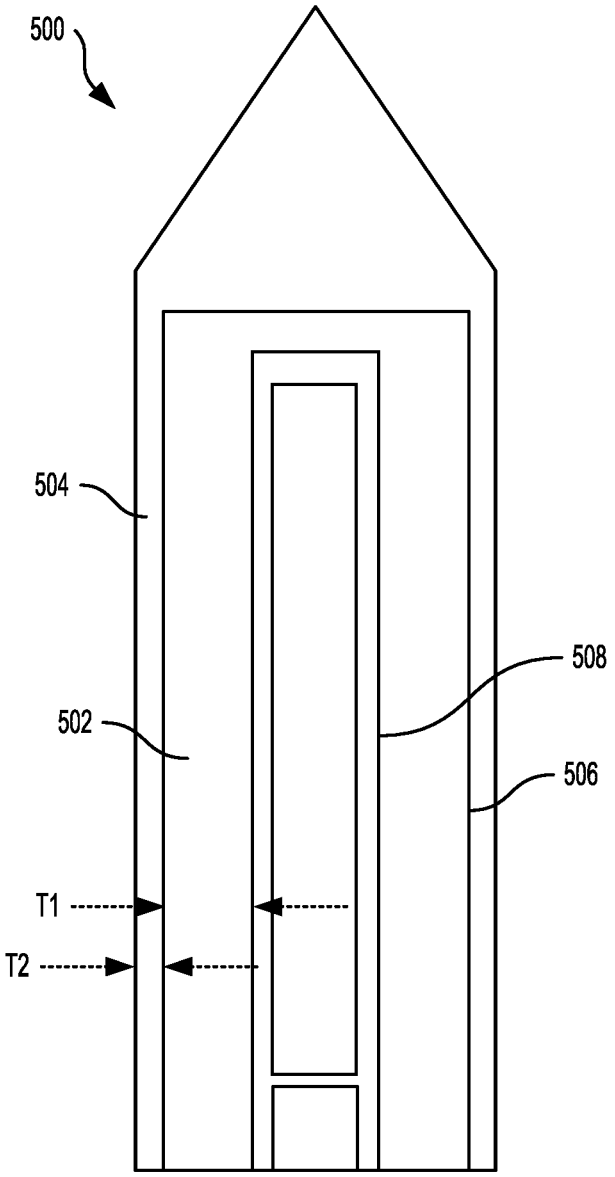
FIG. 5 illustrates an example munition structure of an example munitions, according to an example of the present disclosure.

FIG. 5 illustrates an example munitions 500, according to an example of the present disclosure. The munitions 500 may be similar to, or different than, the munitions 100.

The munitions 500 includes a munitions structure 502 with an axially symmetric shape. Compared to the munitions structure 402, the munitions structure 502 is shown including a casing 504 that at least partially surrounds the munitions structure 502, which may be formed at least in part by the high-strength reactive alloy. In some instances, the casing 504 may be manufactured from steel and/or aluminum alloys, for example. Similar to the munitions structure 402, however, the munitions structure 502 may include an exterior surface 506 (abutting or facing the casing 504), an interior surface 508, and the geometric features 110 (and/or the geometric features 200) may have formed on the exterior surface 506 and/or the interior surface 508. The geometric features 110 may have a GTR, as similarly discuss above with regard to the munitions 400. The munitions structure 502 may also include a thickness T1.

In an embodiment, the casing 504 may enable penetration through one or more protective targets and/or production of blast upon on-demand applied stimulus/stimuli. A thickness T2 the casing 504 may be determined according to desired blast and other characteristics of the munitions 100. In some instances, the thickness T2 and total volume of the casing 504 may be significantly reduced as compared to inert structural material casings in conventional munitions structures. In some instances, where the munitions structure 502 includes a Zr-based bulk metallic glass, the thickness T2 of the casing 504 may be less than 20 mm and/or more than 1 mm, less than 10 mm and/or more than 3 mm. The configuration of reactive bulk metallic glasses into the munitions structure 502 may provide for increased lethality (for both large and small penetrators) by rapidly and simultaneously imparting mechanical energy (kinetic energy through impact, penetration, and fragmentation) and chemical energy (blast and/or fireball to a target).

In an embodiment, the aforementioned thickness T1 and T2 are such that the ratio of T2 to T1 is in the range of 0.2 to 2.0. In some instances, the ratio of T1 to T2 is in the range of 0.5 to 1.0. A higher ratio may provide a more aggressive penetration capability, whereas a lower ratio may provide a more dominant blast and pressure lethality.

FIGS. 6A-6D illustrate different geometric features, according to an example of the present disclosure. For example, beginning with FIG. 6A, a munitions 600 has a munitions structure 602 with geometric features 604 oriented at a non-perpendicular angle relative to a longitudinal axis 606 of the munitions structure 602. In some instances, the geometric features 604 may be oriented at forty-five degrees relative to the longitudinal axis 606. The geometric features 604 may be disposed about a circumference of the munitions structure 602 (e.g., so as to spiral along a surface of the munitions structure 602, and about the longitudinal axis 606).

Figure 6A:
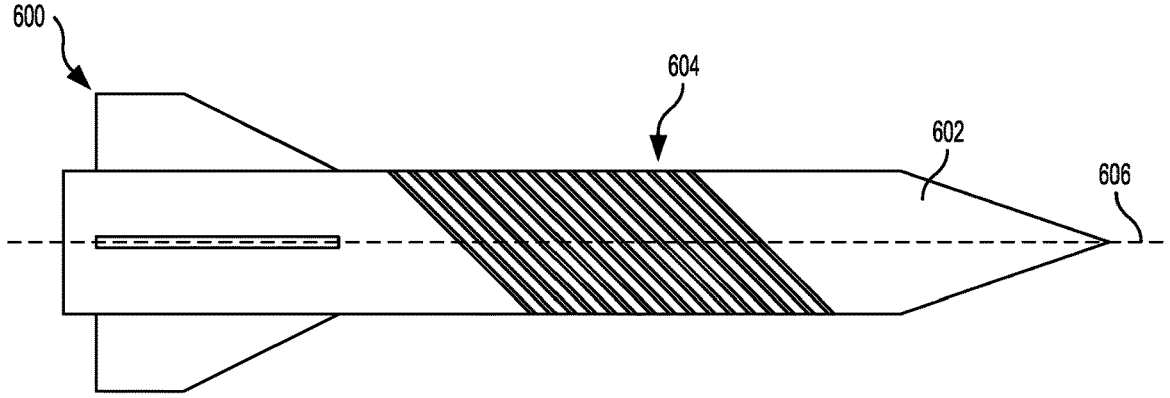
FIGS. 6A-6E illustrate examples of geometric features formed within a munitions structure of a munitions, according to an example of the present disclosure.
Figure 6B:
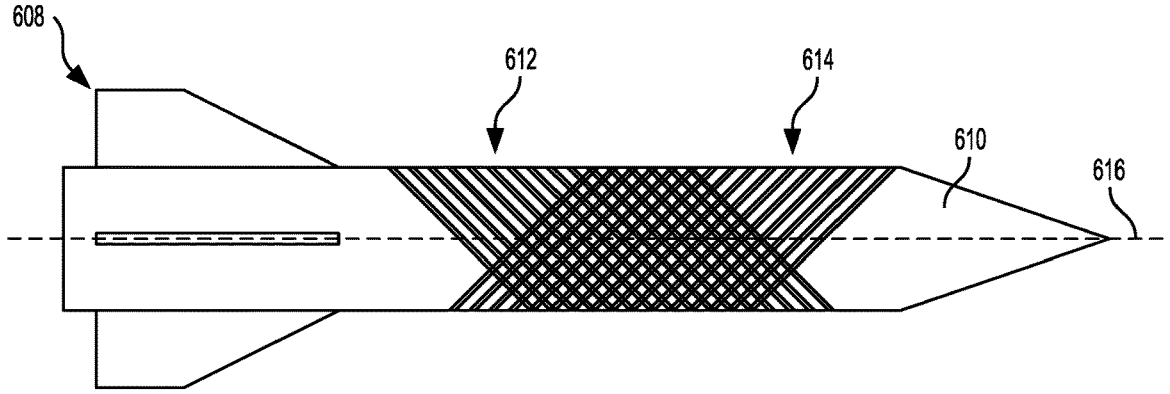

In FIG. 6B, a munitions 608 has a munitions structure 610 with first geometric features 612 and second geometric features 614. The first geometric features 612 and the second geometric features 614 may at least partially overlap with one another (e.g., disposed on a same portion of the munitions structure 610). In some instances, the first geometric features 612 and the second geometric features 614 may be oriented at non-perpendicular angles to a longitudinal axis 616 of the munitions structure 610. In some instances, the first geometric features 612 and the second geometric features 614 may be oriented at different angles as compared to one another.

Figure 6C:
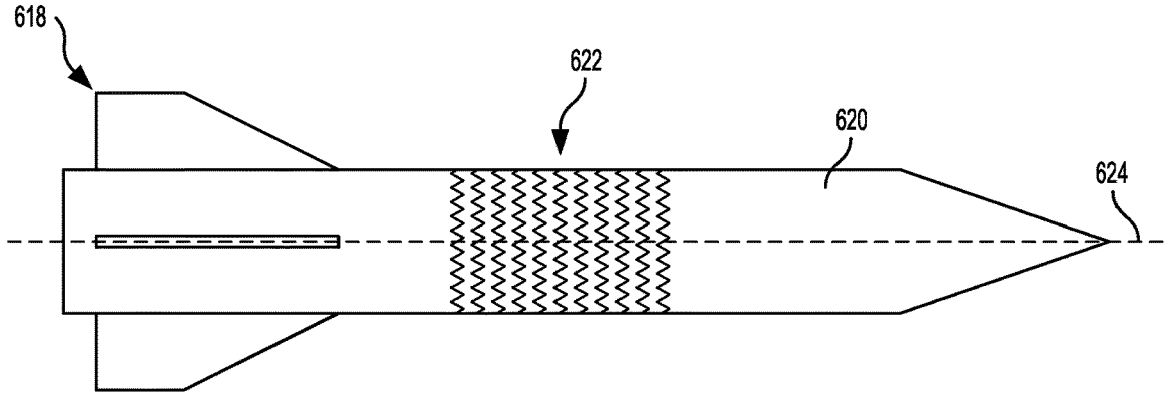

In FIG. 6C, a munitions 618 has a munitions structure 620 with geometric features 622. In some instances, the geometric features 622 may zig-zag, cross-cross, etc. about a longitudinal axis 624 of the munitions structure 620, around a circumference of the munitions structure 620.

Figure 6D:
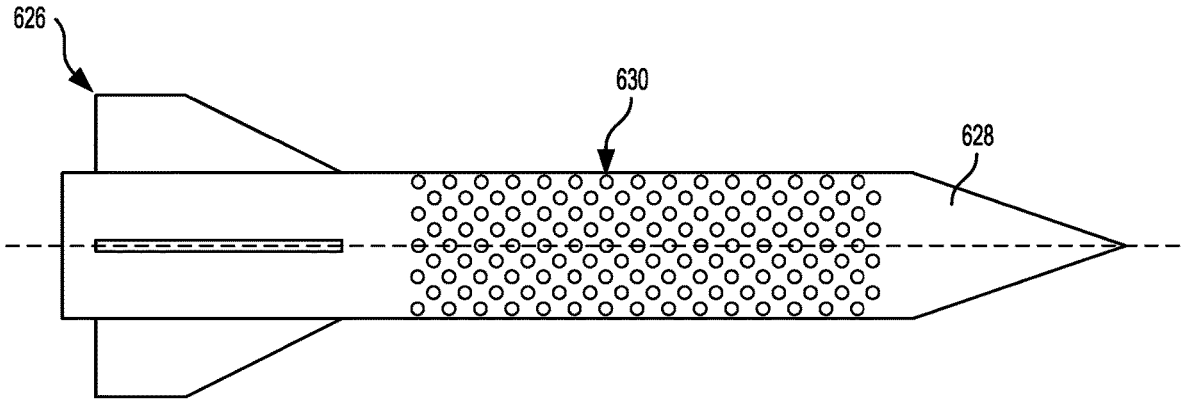

In FIG. 6D, a munitions 626 has a munitions structure 628 with geometric features 630. In some instances, the geometric features 630 may include scallops, dimples, pockets, etc. formed in, on, within, etc. a surface of the munitions structure 628.

Figure 6E:
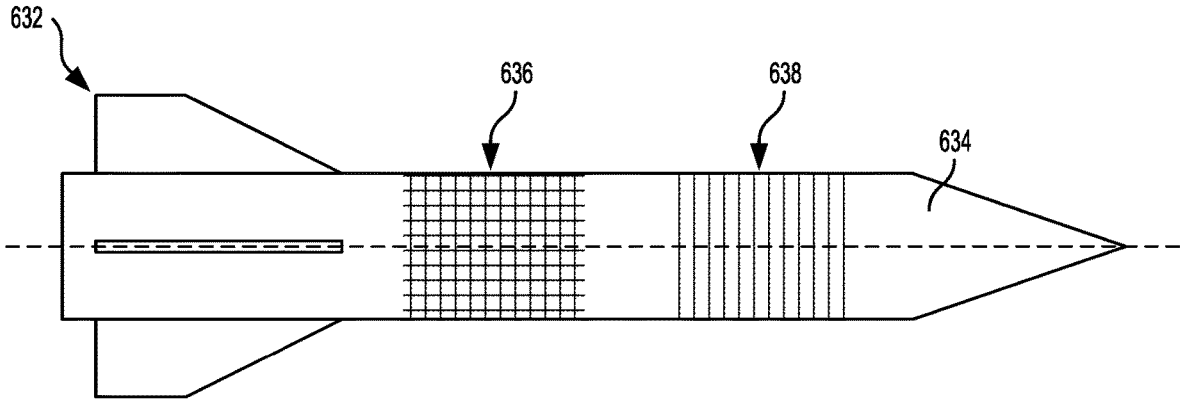

In FIG. 6E, a munitions 632 has a munitions structure 634 with first geometric features 636 and second geometric features 638. The first geometric features 636 and the second geometric features 638 may be different as compared to one another. For example, the first geometric features 636 may include a first orientation, pattern, shape, etc. while the second geometric features 638 may include a second orientation, pattern, shape, etc. that is different than the first orientation, pattern, shape, etc. of the first geometric features 636. The first geometric features 636 and second geometric features 638 may be formed along different lengths, sections, etc. of the munitions structure 634. As such, the munitions structure 634 may include different geometric features.

Although the munitions structures described in FIGS. 6A-6E are shown having certain geometric features, the munitions structures may have different geometric features other than those illustrated and described. Moreover, the geometric features may be disposed on different portions of the munitions structures than illustrated. Additionally, although shown as being formed on an exterior surface of the munitions structure, the geometric features may be formed on an interior surface of the munitions structure.

Figure 7:
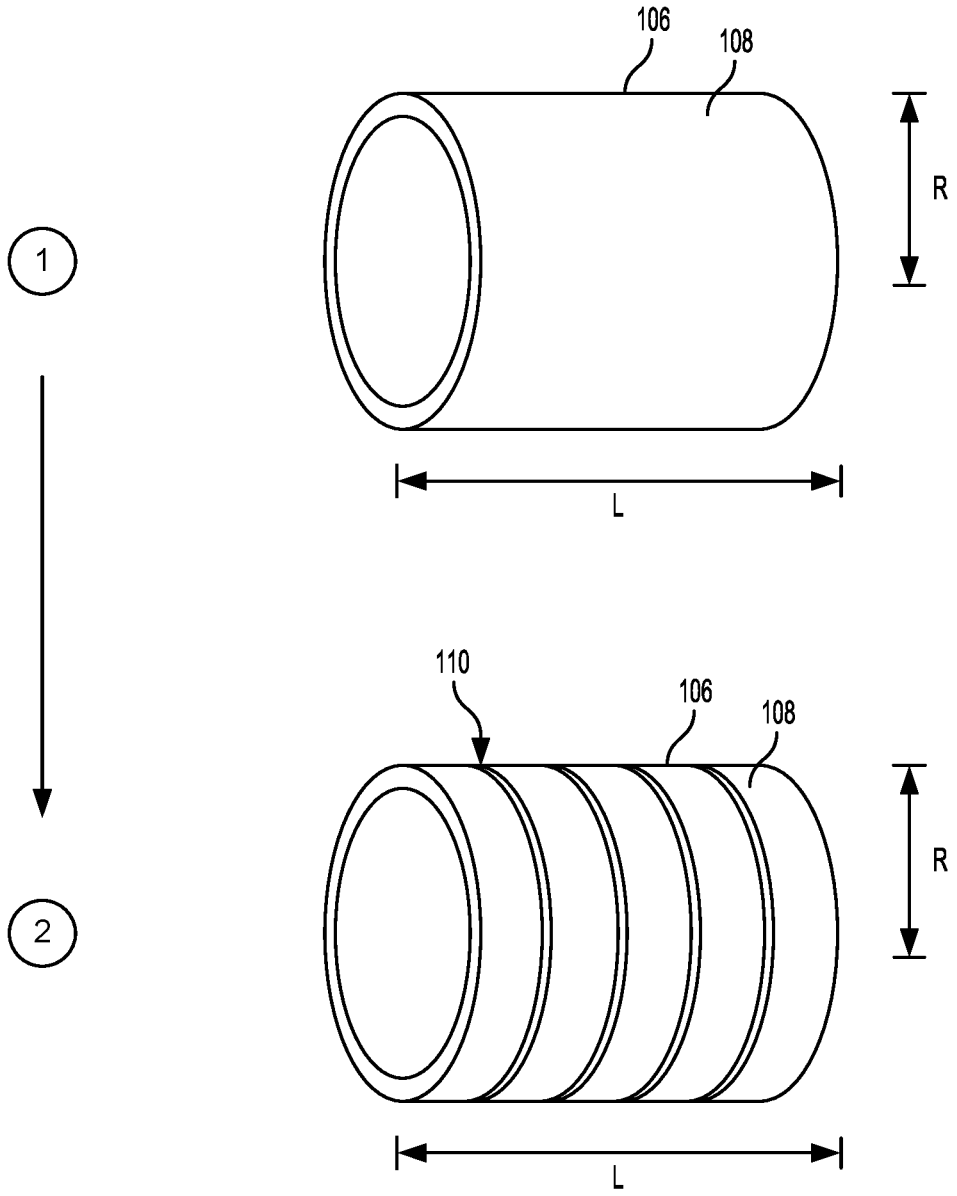
FIG. 7 illustrates an example increase in surface area of a munitions via geometric features formed within a munitions structure of the munitions, according to an example of the present disclosure.

FIG. 7 illustrates an example increase in surface area of the surface 108 of the munitions structure 106, according to an example of the present disclosure. At "1" the munitions structure 106 may have a first surface area (e.g., $2\pi rL+2\pi r^2$) without the geometric features 110. At "2" the munitions structure 106 is shown including the geometric features 110 formed within the surface 108. The formation of the geometric features 110 increases a surface area of the munitions structure 106 (e.g., $2\pi rL+2\pi r^2$+a surface area of the geometric features 110). As such, the munitions structure 106 may have a second surface area that is greater than the first surface area. The increase in the surface area of the munitions structure 106 may be dependent on the shape, size, etc. of the geometric features 110. As introduced above, the GSF may be a ratio of the first surface area to the second surface area.

Figure 8:
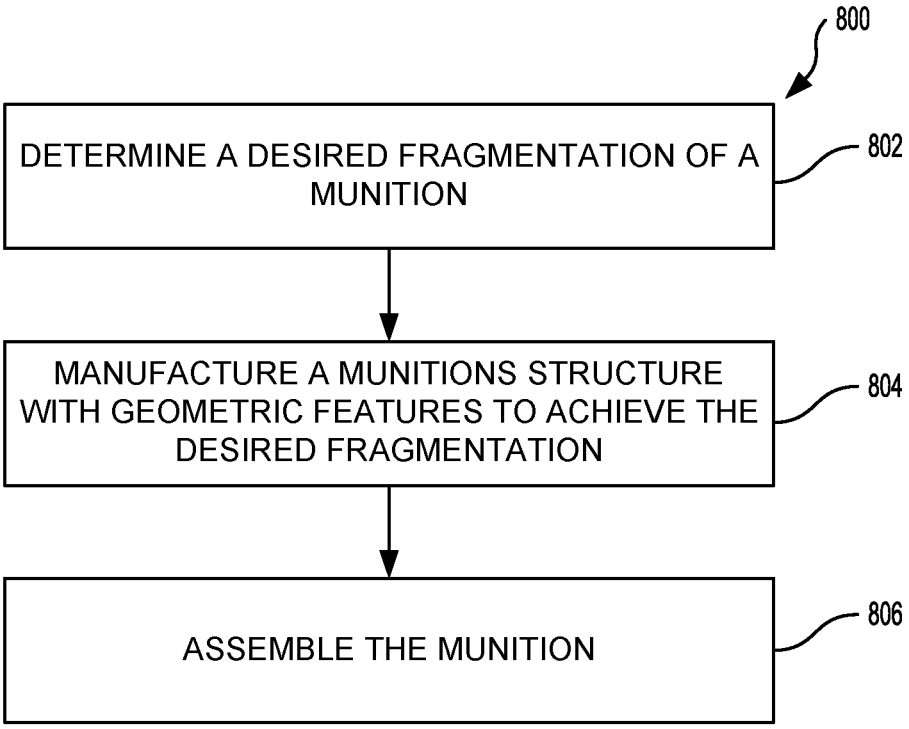
FIG. 8 illustrates an example process for forming a munitions with geometric features, according to an example of the present disclosure.

FIG. 8 illustrates an example process 800 for achieving tailored fragmentation within a munitions, or a munitions structure, according to an example of the present disclosure. At step 802, the process 800 may include determining a desired fragmentation of a munition. For example, different munitions may be manufactured with different desired fragmentations. In some instances, the desired fragmentation may include a certain blast radius, a certain fragment size, an amount of fragments, and so forth. For different missions, objectives, and/or lethality, a certain fragmentation may be desired. In some instances, the desired fragmentation may be based at least in part on a spacing between the geometric features, a location of the geometric features on the munitions structure, dimensions of the geometric features, a geometry/contour of the geometric features, and so forth. In an embodiment, the desired fragmentation may also be based at least in part on a GSF, GTR, etc. of the munitions factor. For example, a larger GSF may result in an increase in the number of fragments.

At 804, the process 800 ma include manufacturing a munitions structure with geometric features to achieve the desired fragmentation. In some instances, the desired fragmentation may be achieved by forming geometric features on the inside (internal cavity or concave surface) of the munitions structure. In some instances, the desired fragmentation may be achieved by forming geometric features on the outside (convex surface) of the munitions structure. In some instances, the desired fragmentation may be achieved by forming geometric features both on the inside (internal cavity or concave surface) and/or on the outside (convex surface) of the munitions structure. In some instances, the geometric features may be fabricated onto the munitions structure by various methods, such as direct machining, as-cast shaping and near-to-net shape thermoplastic forming, in the undercooled liquid state, as in the case of BMGs.

At 806, the process may include assembling the munitions. In some instances, assembling of the munition may include loading explosives into the munitions, installing fuses and/or other control systems, installing stability components (e.g., wings or sabot), and a propulsion unit/propellant in the case self-propelled munitions such as missiles. In some instances, a munitions structure of the munitions has an axially symmetric shape and include a casing. The casing may include a high strength reactive alloy and may be filled with the explosives. Examples of explosives which may be used in such a munitions structure include but are not limited to TNT, HMX and RDX. In some instances, explosives are fitted with one or more fuses. A casing may also have other structural materials such as high strength steel, maraging steel, and aluminum alloys. A munitions structure of this kind with or without explosives may be used, for example, as a warhead in a munitions system.

In some instances, the incorporation of a high-strength reactive alloy, in particular one in BMG form, into munitions structures as described herein with a desired fragmentation may produce both higher blast, rapid pressure increase in ambient environment, and also multiples of kinetic energy projectiles resulting in significant improvement of lethality, which is equivalent to using more explosives and heavier munitions. The high-strength reactive alloys in their bulk solid forms are practically inert under normal operating conditions (ambient temperature and atmosphere). However, these reactive alloys possess significant intrinsic chemical (enthalpic) energy of up to 2,000 calories per gram of alloy and, in the case of some reactive alloys, even more. The munitions structure takes advantage of the intrinsic energy for producing at least part of the blast generated by tailored fragmentation. The chemical energy may be discharged through a combustion reaction with ambient air, in particular oxygen and/or nitrogen. The combustion reaction may be activated upon the fragments impacting onto its target.

Moreover, one or more resulting fragments of the high-strength reactive alloy starts a combustion reaction with the available oxygen/nitrogen. The intrinsic chemical energy of high-strength reactive alloy is discharged via the combustion reaction into the environment, producing rapid pressure increase and blast. This pressure increase may also be associated with a fireball and a high temperature rise in the environment, thereby providing further lethality.

The high-strength reactive alloys as described here have a unique ability to sustain large mechanical strains without significant deformation given their high strength and high elastic strain limit. Once fragmentation of a high-strength reactive alloy starts with the aid of geometric shaping, such stored mechanical energy facilitates the formation of a more uniform fragment distribution as compared with the fragment distribution of conventional munitions systems. Stored mechanical energy from initial stages of rapid impulsive loading preceding and/or concomitant with the initiation of fragmentation opens a large amount of free surfaces which are oxide free from the solid bulk form of the high-strength reactive alloy. The opening of oxide-free free surfaces from the bulk of the high-strength reactive alloy, and especially with the formation of fine and generally uniform fragments, is crucial for the prompt reaction initiation, and increasing the lethality of the munitions structure into which it is incorporated.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A munition comprising:
an explosive; and
a munitions structure substantially enclosing the explosive and being formed from a high-strength reactive alloy, the munitions structure including;
a first surface having one or more grooves, wherein the munitions structure is configured to fragment at least partially along the one or more grooves,
a second surface at least partially forming a cavity in which the explosive is disposed,
a first thickness extending between the first surface and the second surface, the first thickness being external to the one or more grooves, and
a second thickness extending between the first surface and the second surface, the second thickness being internal to the one or more grooves, the second thickness being less than the first thickness.

2. The munition of claim 1, wherein the one or more grooves are formed based at least in part on a desired fragmentation of the munitions structure.

3. The munition of claim 1, wherein the high-strength reactive alloy is a bulk metallic glass material.

4. The munition of claim 1, wherein the one or more grooves are formed from at least one of casting, etching, milling, or thermoplastic forming.

5. The munition of claim 1, wherein the one or more grooves increase a surface area of the first surface.

6. The munition of claim 1, wherein the first surface is an exterior surface.

7. The munition of claim 1, wherein the second surface has one or more second grooves.

8. A munitions structure comprising:
a high-strength reactive alloy in a form of a bulk metallic glass (BMG) material, wherein the BMG material includes:
a first surface having one or more grooves along which the munitions structure is configured to at least partially fragment,
a second surface that at least partially defines a cavity in which an explosive is configured to reside,
a first thickness disposed between the first surface and the second surface, the first thickness being at a location external to the one or more grooves, and
a second thickness disposed between the first surface and the second surface, the second thickness being at a location within the one or more grooves, the second thickness being less than the first thickness.

9. The munitions structure of claim 8, wherein the one or more grooves include at least one of a V-shaped cross-section or a C-shaped cross-section.

10. The munitions structure of claim 8, wherein the one or more grooves are spaced apart from one another between 2.0 millimeters (mm) and 5.0 mm.

11. The munitions structure of claim 8, wherein:
the first surface further includes one or more second grooves along which the munitions structure is configured to at least partially fragment; and
the one or more second grooves are different than the one or more grooves.

12. The munitions structure of claim 8, wherein the second surface has one or more second grooves along which the munitions structure is configured to at least partially fragment.

13. The munitions structure of claim 8, wherein:
without the one or more grooves, the first surface has a first surface area;
with the one or more grooves formed in the first surface, the first surface has a second surface area; and
a ratio of the second surface area to the first surface area is in a range from 1.2 to 3.0.

14. The munitions structure of claim 8, wherein at least one of a dimension or a quantity of the one or more grooves is based at least in part on a desired fragmentation of the munitions structure.

15. The munitions structure of claim 8, wherein the high-strength reactive alloy has an elastic strain limit of at least 1.2% and an enthalpy of oxidation of at least 1,400 calories per gram.

16. A bulk metallic glass (BMG) material comprising:
at least one high strength reactive alloy including;
a first surface on which one or more surface features are formed, wherein the one or more surface features are configured to at least partially control a fragmentation of the BMG material, and a second surface:

a first thickness extending between the first surface and the second surface, the first thickness being at a first location external to the one or more surface features:

a second thickness extending between the first surface and the second surface, the second thickness being at a second location internal to the one or more surface features, the second thickness being less than the first thickness, wherein a ratio of the second thickness to the first thickness is between 0.05 to 0.5; and a cavity within which an explosive is configured to reside.

17. The BMG material of claim 16, wherein:

the one or more surface features include grooves formed into the first surface; and the grooves include at least one of a V-shaped cross-section or a C-shaped cross-section.

18. The BMG material of claim 16, wherein the first surface is disposed at least partially within the cavity in which the explosive is configured to reside.

19. The BMG material of claim 16, wherein the BMG material includes one or more second surface features formed in the second surface.

20. The munition of claim 1, wherein a ratio of the second thickness to the first thickness is between 0.05 to 0.5.

* * * * *